US006727872B2

(12) United States Patent
Pfeiffer et al.

(10) Patent No.: US 6,727,872 B2
(45) **Date of Patent: *Apr. 27, 2004**

(54) IMAGE QUALITY IMPROVEMENT FOR LIQUID CRYSTAL DISPLAY

(75) Inventors: Matthias Pfeiffer, Mesa, AZ (US); Terrence R. Klein, Averill Park, NY (US); Russell J. Flack, Scottsdale, AZ (US); John Karl Waterman, Mesa, AZ (US)

(73) Assignee: Brillian Corporation, Tempe, AZ (US)

( * ) Notice: Subject to any disclaimer, the term of this patent is extended or adjusted under 35 U.S.C. 154(b) by 159 days.

This patent is subject to a terminal disclaimer.

(21) Appl. No.: 09/972,745

(22) Filed: Oct. 8, 2001

(65) Prior Publication Data

US 2002/0097207 A1 Jul. 25, 2002

Related U.S. Application Data

(60) Provisional application No. 60/263,355, filed on Jan. 22, 2001.

(51) Int. Cl.[7] ..... G09G 3/36
(52) U.S. Cl. ..... 345/87; 345/89
(58) Field of Search ..... 345/87, 89, 90, 345/91, 93, 98, 100, 101, 206, 205, 211, 212, 213, 214, 215

(56) References Cited

U.S. PATENT DOCUMENTS 5,471,228 A 11/1995 Ilcisin et al. ..... 345/58
5,739,816 A 4/1998 Kobayashi et al. ..... 345/204
6,025,818 A * 2/2000 Okano ..... 345/63
6,204,833 B1 * 3/2001 Hayashi et al. ..... 345/58

FOREIGN PATENT DOCUMENTS

| | | | |
|---|---|---|---|
| EP | 0700028 A1 | 3/1996 | ..... G09G/3/36 |
| EP | 0720139 A2 | 7/1996 | ..... G09G/3/22 |
| EP | 0720139 A3 | 7/1997 | ..... G09G/3/22 |
| WO | WO 99/30310 | 6/1999 | ..... G09G/3/28 |

OTHER PUBLICATIONS

Eliminating Crosstalk in Thin–Film Transistor/Liquid–Crystal Displays, Howard et al.; IEEE Transactions on Electron Devices 36 (1989) Sep., No. 9–I, New York, US.

European Search Report Dated May 14, 2002.

Abstract 02001416.3.

* cited by examiner

*Primary Examiner*—Vijay Shankar
(74) *Attorney, Agent, or Firm*—Baker Botts L.L.P.

(57) ABSTRACT

A liquid crystal display (LCD) system, comprising a matrix of pixels, analyzes a video data stream for grayscale level jumps from extreme black to moderate gray levels. Transitions in grayscale levels are restricted between adjacent pixels so as to reduce image degradation due to fringe field effects. A memory, such as a shift register, may be used to store and then grayscale levels to be written to adjacent pixels are compared and if a difference between these grayscale levels exceed a certain value then at least one of the grayscale levels is modified.

20 Claims, 14 Drawing Sheets

IMAGE QUALITY IMPROVEMENT FOR LIQUID CRYSTAL DISPLAY

RELATED APPLICATION

This application claims the benefit of Provisional Application No. 60/263,355 filed Jan. 22, 2001.

The application is related to co-pending application Ser. No. 09/972,746, entitled "Image Quality Improvement for Liquid Crystal Displays" by Matthias Pfeiffer, Terence R. Klein, Russell J. Flack, and John Karl Waterman, filed Oct. 8, 2001, which is incorporated herein by reference for all purposes.

FIELD OF THE INVENTION

The present invention relates generally to liquid crystal display (LCD) devices, and more particularly to a system, apparatus and method for improving image quality by limiting the difference between gray scale values of adjacent pixels.

BACKGROUND OF THE INVENTION TECHNOLOGY

Liquid crystal displays (LCDs) are commonly used in devices such as portable televisions, portable computers, control displays, and cellular phones to display information to a user. LCDs act in effect as a light valve, i.e., they allow transmission of light in one state, block the transmission of light in a second state, and some include several intermediate stages for partial transmission. When used as a high resolution information display, as in one application of the present invention, LCDs are typically arranged in a matrix configuration with independently controlled display areas called "pixels" (the smallest segment of the display). Each individual pixel is adapted to selectively transmit or block light from a backlight (transmission mode), from a reflector (reflective mode), or from a combination of the two (transflective mode).

A LCD pixel can control the transference for different wavelengths of light. For example, an LCD can have pixels that control the amount of transmission of red, green, and blue light independently. In some LCDs, voltages are applied to different portions of a pixel to control light passing through several portions of dyed glass. In other LCDs, different colors are projected onto the area of the pixel sequentially in time. If the voltage is also changed sequentially in time, different intensities of different colors of light result. By quickly changing the wavelength of light to which the pixel is exposed an observer will see the combination of colors rather than sequential discrete colors. Several monochrome LCDs can also result in a color display. For example, a monochrome red LCD can project its image onto a screen. If a monochrome green and monochrome blue LCD are projected in alignment with the red, the combination will be a full range of colors.

The monochrome resolution of an LCD can be defined by the number of different levels of light transmission or reflection that each pixel can perform in response to a control signal. A second level is different from a first level when a user can tell the visual difference between the two. An LCD with greater monochrome resolution will look clearer to the user.

LCDs are actuated pixel-by-pixel, either one at a time or a plurality simultaneously. A voltage is applied to each pixel area by charging a capacitor formed in the pixel area. The liquid crystal responds to the charged voltage of the pixel capacitance by twisting and thereby transmitting a corresponding amount of light. In some LCDs an increase in the actuation voltage decreases transmission, while in others it increases transmission. When multiple colors are involved for each pixel, multiple voltages are applied to the pixel at different positions (different capacitance areas being charged of a pixel) or times depending upon the LCD illumination method. Each voltage controls the transmission of a particular color. For example, one pixel can be actuated for only blue light to be transmitted while another for green light, and a third for red light. A greater number of different light levels available for each color results in a much greater number of possible color combinations. Colors may be combined from a red pixel, a green pixel and a blue pixel, each residing on a different LCD, to produce any desired combined pixel color. The three LCDs (red-green-blue or RGB) are optically aligned so that the resulting light from each of the corresponding RGB pixels produces one sharp color pixel for each of the pixels in the LCD pixel matrix. The LCD pixel matrix is adapted for displaying one frame of video per light strobe. Each light strobe (RGB) produces one video frame. A sequence of video frames produces video images that may change over time (e.g., motion video).

Converting a complex digital signal that represents an image or video into voltages to be applied to charge the capacitance of each pixel of an LCD involves circuitry that can limit the monochrome resolution. The signals necessary to drive a single color of an LCD are both digital and analog. It is digital in that each pixel requires a separate selection signal, but it is analog in that an actual voltage is applied to charge the capacitance of the pixel in order to determine light transmission thereof.

Each pixel in the array of the LCD is addressed by both a column (vertical) driver and a row (horizontal) driver. The column driver turns on an analog switch that connects an analog voltage representative of the video input (control voltage necessary for the desired liquid crystal twist) to the column, and the row driver turns on a second analog switch that connects the column to the desired pixel.

The video inputs to the LCD are analog signals centered around a center reference voltage of typically from about 6.5 to 8.0 volts. A voltage equal or close to this center reference voltage is called "VCOM" and is supplied to the LCD Cover glass electrode which is a transparent conductive coating on the inside face (liquid crystal side) of the cover glass. This transparent conductive coating is typically Indium Tin Oxide (ITO).

One frame of video pixels are run at voltages above the center reference voltage (positive inversion) and for the next frame the video pixels are run at voltages below the center reference voltage (negative inversion). Alternating between positive and negative inversions results in substantially a zero net DC bias at each pixel. This substantially reduces the "image sticking" phenomena.

LCD technology has reduced the size of displays from full screen sizes to minidisplays less than 1.3 inches diagonal measurement, to microdisplays that require a magnification system. Microdisplays may be manufactured using semiconductor integrated circuit (IC) dynamic random access memory (DRAM) process technologies. The microdisplays consist of a silicon substrate backplane, a cover glass and an intervening liquid crystal layer. The microdisplays are arranged as a matrix of pixels arranged in a plurality of rows and columns, wherein an intersection of a row and a column defines a position of a pixel in the matrix. To incident light, each pixel is a liquid crystal cell above a reflecting mirror.

By changing the liquid crystal state, the incident light can be made to change its polarization. The silicon backplane is an array of pixels, typically 10 to 20 microns in pitch. Each pixel has a mirrored surface that occupies most of the pixel area. The mirrored surface is also an electrical conductor that forms a pixel capacitor with the ITO layer as the other plate of the pixel capacitor (common to all pixel capacitors in the matrix of pixels. As each pixel capacitor is charged to a certain pixel value, the liquid crystals between the plates of the pixel capacitors "twist" or "untwist" which affects the polarization of the light incident to the pixels (reflections from the pixel mirrors).

Microdisplays may have an analog video signal input ("analog display") or a digital video signal input (digital display). Analog displays, generally, are addressed in a raster mode, while the pixels in a digital display may be addressed like a DRAM, in a random order. Random access allows updating only pixels requiring updating, thus saving on processing time and associated power consumption.

A problem exists in small LCDs, especially microdisplays, which have small pixel cell areas compared to the area of the gaps between the pixel cells. Fringe fields between the pixels are therefore significant in magnitude and the area affected by fringe fields is significant with respect to the overall pixel area. This leads to image degradation of increasing severity for small LCDs and high driving voltages. Limiting the driving voltages helps, but reduces the available contrast of the LCD.

SUMMARY OF THE INVENTION

The present invention overcomes the above-identified problems as well as other shortcomings and deficiencies of existing technologies by providing a system, method and apparatus for improving image quality of a liquid crystal display (LCD) by modifying the video source values written to the pixels in order to smooth the magnitude of voltage transitions from one adjacent pixel to another. If the voltage transitions between adjacent pixels is too large in magnitude, the large voltage transition can generate a strong fringe field effect between the adjacent pixels.

A liquid crystal on silicon (LCoS) microdisplay is adapted to receive video information from a digital video data source. The LCoS microdisplay may operate, e.g., in a normally white twisted nematic LC mode. A rubbing direction may be selected so that disclinations appear preferably at vertical pixel borders (between columns), e.g., a 60 degree twist self-compensated reflective twisted nematic mode. If a source image with black areas surrounded by light gray areas is displayed, a white line may be observed within a gray area that borders the black area on one side thereof, while on the other side of the black area a white spot may be observed therein. If the source video image for the pixels at the border of the gray/black areas are modified, e.g., a normally black pixel written more toward gray (lighter than black but darker than the normal gray), or a gray pixel written more toward black (darker), then the resulting LCD video image has significantly less image distortion due to fringe effect fields. Such a slight reduction in the blackness of a pixel or reduction of lightness of a pixel next to a black pixel has a strong effect in the applied voltage since the electro-optical response of the liquid crystal has a small gradient close to the saturation voltage for a black pixel.

For exemplary purposes in describing the embodiments disclosed herein, a pixel voltage value (the voltage value charge on the pixel capacitor) representing black may be referred to as black or level A ($\mathbf{00}_h$ input to an 8-bit DAC), and a pixel voltage value representing white may be referred to as white or level D ($FF_h$ input to the 8 bit DAC). Gray levels may be referred to as gray or level C (greater than black—$\mathbf{00}_h$ and less than white—$FF_b$ to the 8 bit DAC).

In an exemplary embodiment of the invention, the video source data is fed into a shift register. A comparator analyzes the pixel values in the shift register and restricts all pixels values less than B that are adjacent to pixel values having at least a gray level C to substantially black video values of level B ($\mathbf{00}_h$<B<C). Alternatively, the pixels values less than level B may be reduced by a factor k (increases the gray level), if the pixel to be written to borders a gray level pixel having a gray level between C and D, where k, B and C are parameters that may be selected for the most pleasing images. For a sequential color LCD system, only one shift register need be used. For a three color (red-green-blue) LCD system, three shift registers may be used, one for each color portion of the RGB LCDs.

In another exemplary embodiment of the invention, the video source pixel data that was written to a previous row is stored in a video memory so that a comparison of previous row pixel value data can be made and the present row video source pixel data modified as describe herein. Thus both adjacent column and row pixels may be compared so that any adjacent pixel will not be written to a voltage level producing a fringe field great enough to cause image degradation (disclination).

In another exemplary embodiment of the invention, the magnitude change in adjacent pixel voltage values will be reduced by averaging the required magnitude change over a sufficient number of pixels so that no adjacent pixels will have a voltage value change larger than a desired magnitude. This may be accomplished by dividing the input video data voltage value magnitude change between adjacent pixels by the desired voltage value magnitude change to determine the "number of pixels" over which the total video data voltage value magnitude change can be obtained without exceeding the desired voltage value magnitude change between any two adjacent pixels. This results in a more gradual change in voltage values, e.g., "stair stepping" adjacent pixel voltage value changes over the number of adjacent pixels until reaching the total video data voltage value magnitude change.

Adjacent pixels on the same row may be as described herein as well as adjacent pixels on adjacent rows. It is contemplated and within the scope of the present invention that a video memory may be utilized to store voltage values written to pixels on previous rows and/or columns so that no adjacent pixel has a voltage value difference great enough to cause field fringe effects.

The present invention is directed to a system for improving image quality of a liquid crystal display (LCD), said system comprising: a matrix of pixels arranged in a plurality of columns and a plurality of rows, wherein an intersection of a row and a column defines a location of a pixel in said matrix; at least one digital-to-analog converter (DAC) having a digital input and an analog output; a plurality of column switches adapted for coupling the analog output of said at least one DAC to each of said plurality of columns; a plurality of row switches adapted for selectively coupling each of said plurality of rows to said plurality of columns; column control logic for controlling said plurality of column switches; row control logic for controlling said plurality of row switches; a video frame to gray scale conversion and pixel address logic for converting video information into LCD gray scale values and corresponding pixel address locations thereof; and video data comparator/modifier logic, said video data comparator/modifier logic adapted to receive the LCD gray scale values for each pixel of the matrix of pixels, wherein gray scale values of adjacent pixels are compared and if a difference in magnitudes between the gray scale values of adjacent pixels is greater than a desired value, then at least one of the gray scale values is modified so that the difference in magnitudes therebetween is no greater than the desired value; said video data comparator/modifier logic is adapted for sending all unmodified gray scale values and any modified gray scale values to said at least one DAC; said video frame to gray scale conversion and pixel address logic adapted for sending said pixel address locations to said column control logic and said row control logic.

The present invention is also directed to a method of operation for improving image quality of a liquid crystal display (LCD) comprising a matrix of pixels arranged in a plurality of rows and columns, wherein an intersection of a row and a column defines a position of a pixel in the matrix, said method comprising the steps of: determining if a gray scale value of a pixel is greater than a first reference value and writing the gray scale value to the pixel location, wherein if the gray scale value of the pixel is less than or equal to the first reference value, then writing a gray scale value of an adjacent pixel to the adjacent pixel, and if the gray scale value of the pixel is greater than the first reference value, then determining if the gray scale value of the adjacent pixel is less than a second reference value, if so, then writing the second reference value to the adjacent pixel, and if not, then writing the gray scale value of the adjacent pixel to the adjacent pixel.

The present invention is also directed to a method of operation for improving image quality of a liquid crystal display (LCD) comprising a matrix of pixels arranged in a plurality of rows and columns, wherein an intersection of a row and a column defines a position of a pixel in the matrix, said method comprising the steps of: determining if a gray scale value of a pixel is greater than a first reference value and writing the gray scale value to the pixel location, wherein if the gray scale value of the pixel is less than or equal to the first reference value, then writing a gray scale value of an adjacent pixel to the adjacent pixel, and if the gray scale value of the pixel is greater than the first reference value, then determining if the gray scale value of the adjacent pixel is less than a second reference value, if so, then multiplying the gray scale value of the adjacent pixel by k and writing the product thereof to the adjacent pixel, and if not, then writing the gray scale value of the adjacent pixel to the adjacent pixel.

The present invention is also directed to a method of operation for improving image quality of a liquid crystal display (LCD) comprising a matrix of pixels arranged in a plurality of rows and columns, wherein an intersection of a row and a column defines a position of a pixel in the matrix, said method comprising the steps of: determining if a gray scale value of a pixel is greater than a first reference value and writing the gray scale value to the pixel location, wherein if the gray scale value of the pixel is less than or equal to the first reference value, then writing a gray scale value of an adjacent pixel to the adjacent pixel, and if the gray scale value of the pixel is greater than the first reference value, then determining if the gray scale value of the adjacent pixel is less than a second reference value, if so, then dividing the difference between the gray scale values of the pixel and the adjacent pixel by I and storing the result as N and changing the next N adjacent pixel gray scale values by no more than I, and writing the changed next N gray scale values to the next N adjacent pixels, and if not, then writing the gray scale value of the adjacent pixel to the adjacent pixel.

A technical advantage of the present invention is improved image quality in microdisplays. Another technical advantage is in smoothing transitions between pixel voltages that generate strong fringe field effects. Other technical advantages of the present disclosure will be readily apparent to one skilled in the art from the following figures, descriptions, and claims. Various embodiments of the invention obtain only a subset of the advantages set forth. No one advantage is critical to the invention.

BRIEF DESCRIPTION OF THE DRAWINGS

A more complete understanding of the present disclosure and advantages thereof may be acquired by referring to the following description taken in conjunction with the accompanying drawings, wherein.

Figure 1:
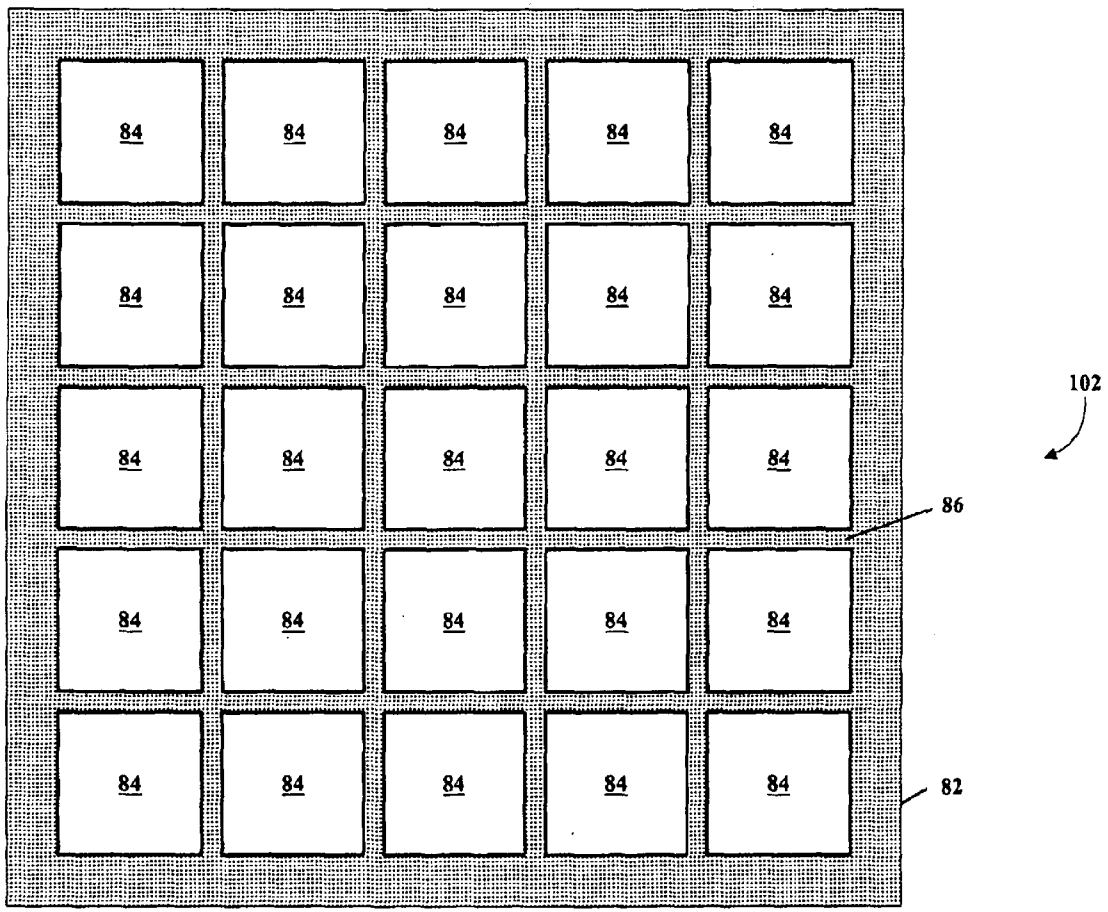
FIG. 1 is a schematic plan view of a portion of a liquid crystal display.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

The present invention is directed to a liquid crystal display (LCD) comprising a matrix of liquid crystal pixels having light modifying properties controlled by voltage values stored in capacitors comprising the areas representing the pixels in the matrix of pixels of the LCD. A plurality of digital-to-analog converters (DACs) are coupled through analog switches to columns of the pixel matrix for voltage charging of the columns. Row analog switches connect each column to a desired respective pixel capacitor plate on a selected row, thereby transferring the voltage values on the columns to the respective pixel capacitors. The embodiments of the invention improve image quality of a liquid crystal display (LCD) by modifying the video voltage values written to the pixel capacitors in order to reduce the magnitude change of voltage transitions from one adjacent pixel area to another. If the voltage change transition between adjacent pixel areas is too large in magnitude, the voltage change transition can generate a strong fringe field effect between the adjacent pixel areas call "disclinations."

Referring now to the drawings, the details of preferred embodiments of the invention are schematically illustrated. Like elements in the drawings will be represented by like numbers, and similar elements will be represented by like numbers with a different lower case letter suffix.

Figure 3:
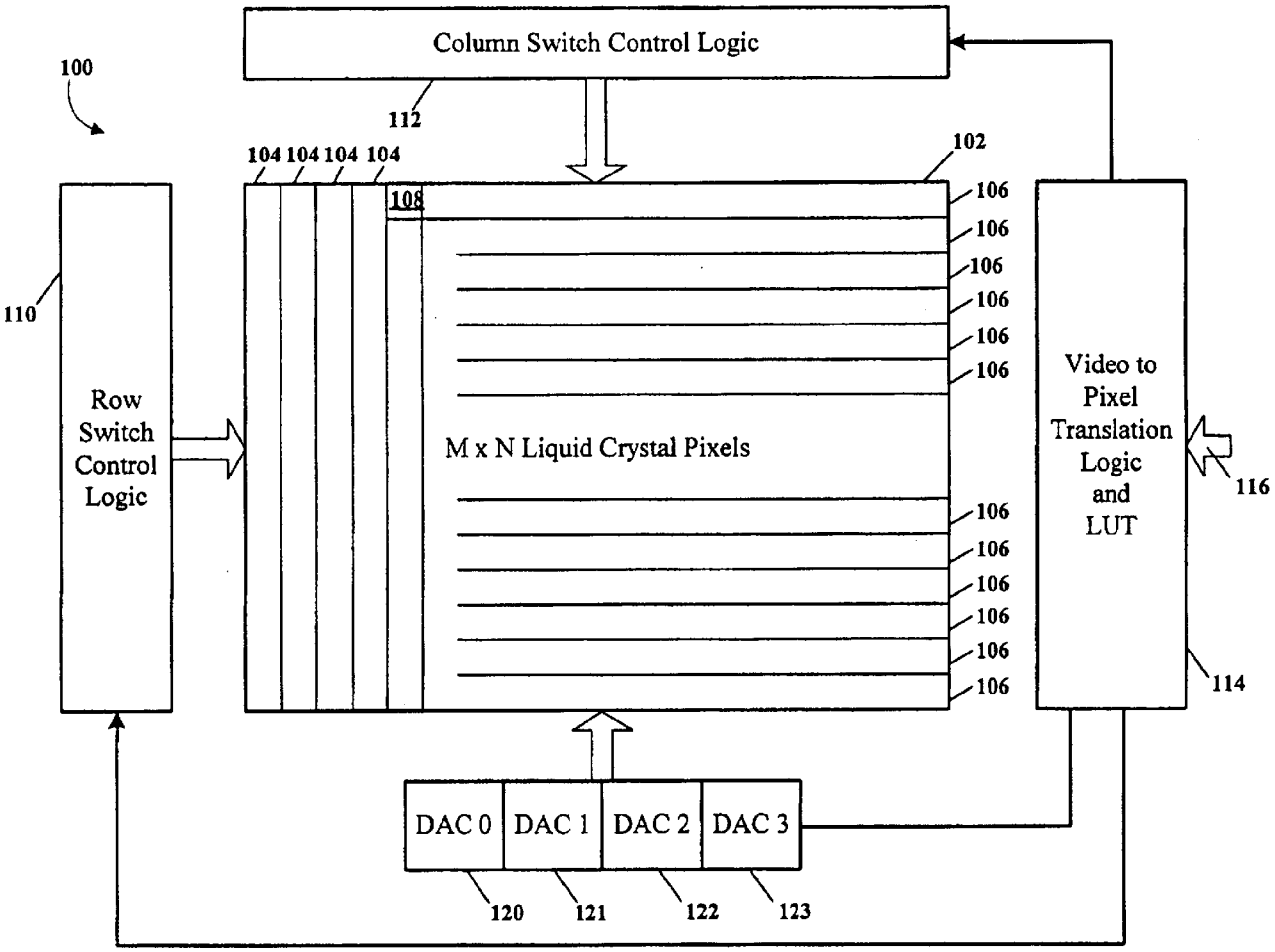
FIG. 3 is a schematic block diagram of a liquid crystal display system.

Referring to FIG. 1, depicted is a schematic plan view of a portion of a liquid crystal display (LCD). The LCD is generally represented by the numeral 102 and comprises a plurality of pixels 108 (FIG. 3). Each pixel 108 has a respective pixel capacitor plate or "mirror" 84. The pixels 108 are arranged in a matrix array. In an exemplary embodiment of the invention, pixel mirrors 84 are disposed on a silicon substrate 82. A pixel mirror 84 forms one plate of a pixel capacitor, the other pixel capacitor plate is formed by the transparent ITO layer. The substrate 82 may be a semiconductor integrated circuit die having transistors fabricated therein and some of these transistors may be connected to the pixel mirrors 84. Spaces 86 between the pixel mirrors 84 are very small and a voltage potential difference of large enough magnitude between adjacent pixel mirrors 84 may cause disclinations in the liquid crystal material.

Figure 2:
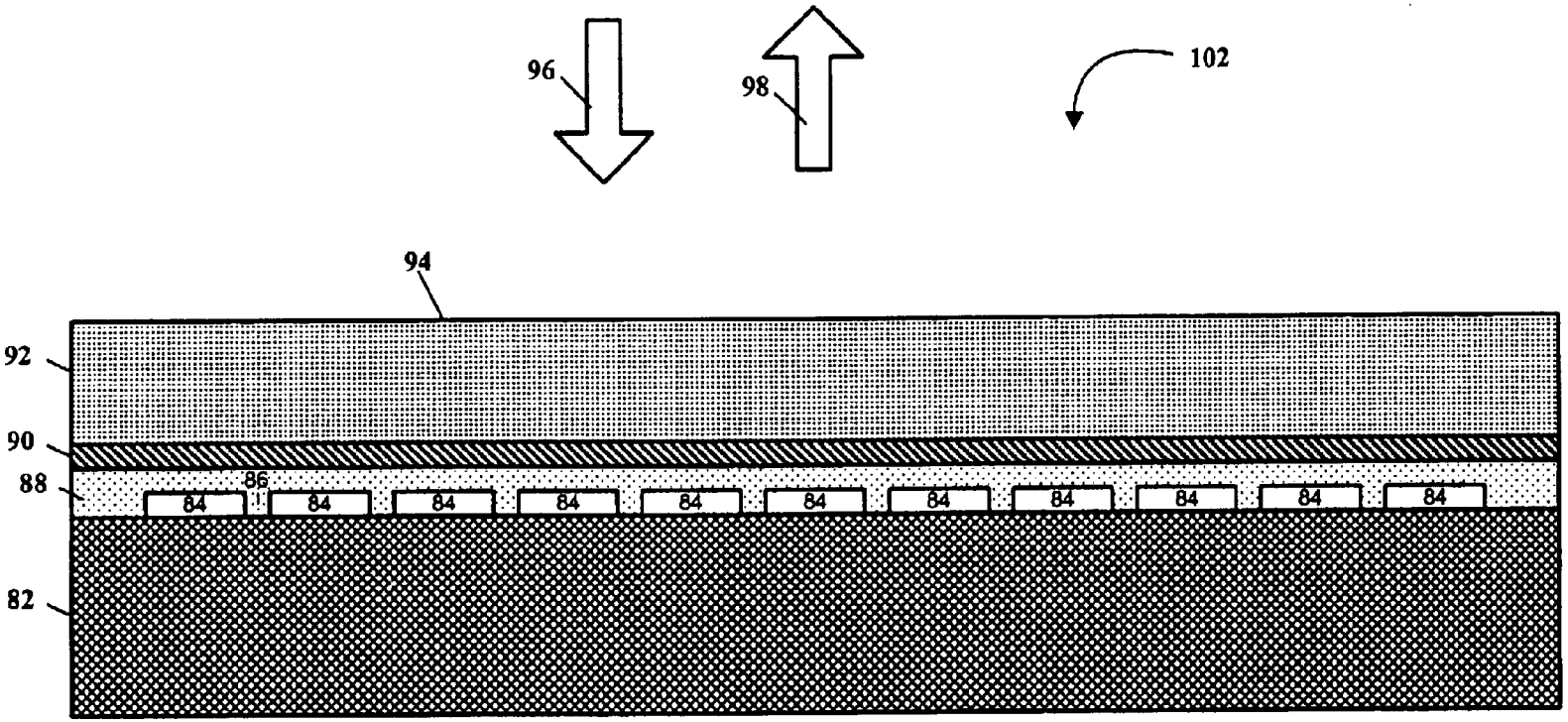
FIG. 2 is a schematic elevational view of a portion of the liquid crystal display of FIG. 1.

Referring now to FIG. 2, depicted is a schematic elevational view of a portion of the liquid crystal display of FIG. 1. The LCD 102 comprises the substrate 82 on which the pixel mirrors 84 are transposed on a surface thereof. Liquid crystal material 88 surrounds the pixel mirrors 84. A transparent cover 92, e.g., glass or plastic, has on one side thereof a transparent electrically conductive coating 90, e.g., Indium Tin Oxide (ITO), that forms the other capacitor plate for the pixel mirrors 84. An outside face 94 of the cover 92 is the viewed portion of the LCD 102. Typically, light 96 is flashed onto the outside face 94 of the LCD 102, and the liquid crystal material 88 modifies light 98 that is reflected from the pixel mirrors 84. Each pixel mirror 84 in combination with the ITO layer 90 has a unique voltage charge therebetween which modifies the twist of the liquid crystal material 88 that is within that voltage charge. The amount of twist of the liquid crystal material 88 determines how much light 96 is returned as the reflected light 98 (light polarization filters, not illustrated, are also utilized in combination with the liquid crystal modified light polarization). A sharp and clear video frame will have smooth and distinct light polarization transitions between the pixel mirrors 84, however, when the voltage difference between adjacent pixel mirrors 84 is too large, disclinations may occur. The present invention overcomes these disclinations by limiting the magnitude of the voltage difference between the adjacent pixel mirrors 84.

Referring to FIG. 3, depicted is a schematic block diagram of a liquid crystal display system. A high-level block diagram of a system for writing voltage values to pixels of a liquid crystal display (LCD) system is generally represented by the numeral 100. The voltage values being written to the pixels are representative of a frame of video data. The voltage values control the "twist" of the liquid crystal material at each pixel area so that when a light is flashed on or through the LCD, the light polarization and ultimately the intensity of the light passing through a polarization filter is controlled by the "twist" of the liquid crystal material at each pixel area of the LCD.

For illustrative and exemplary purposes, the LCD 100 depicted in FIG. 3 comprises a pixel matrix 102 of M rows 106 by N columns 104 for a total of M×N individually addressable pixels 108. The combination of row control logic 110 and column control logic 112 are used to select each of the pixels 108 for writing thereto in the LCD 100, as more fully described herein. Video to pixel translation logic and a look-up table (LUT) (hereinafter translation logic) 114 perform the necessary calculations and steps to translate a video frame image 116 into discrete digital values, each digital value representing a pixel video voltage value. The digital values are sent to digital-to-analog converters (DACs) 120, 121, 122 and 123, and the pixel location addresses thereof are sent to the row and column control logic 110 and 112.

It is contemplated and within the scope of the present invention that any number of DACs may be used according to exemplary embodiments of the present invention. The DACs 120, 121, 122 and 123 have outputs comprising analog values, e.g., voltage or current, corresponding to digital input words from the translation logic 114.

Figure 4:
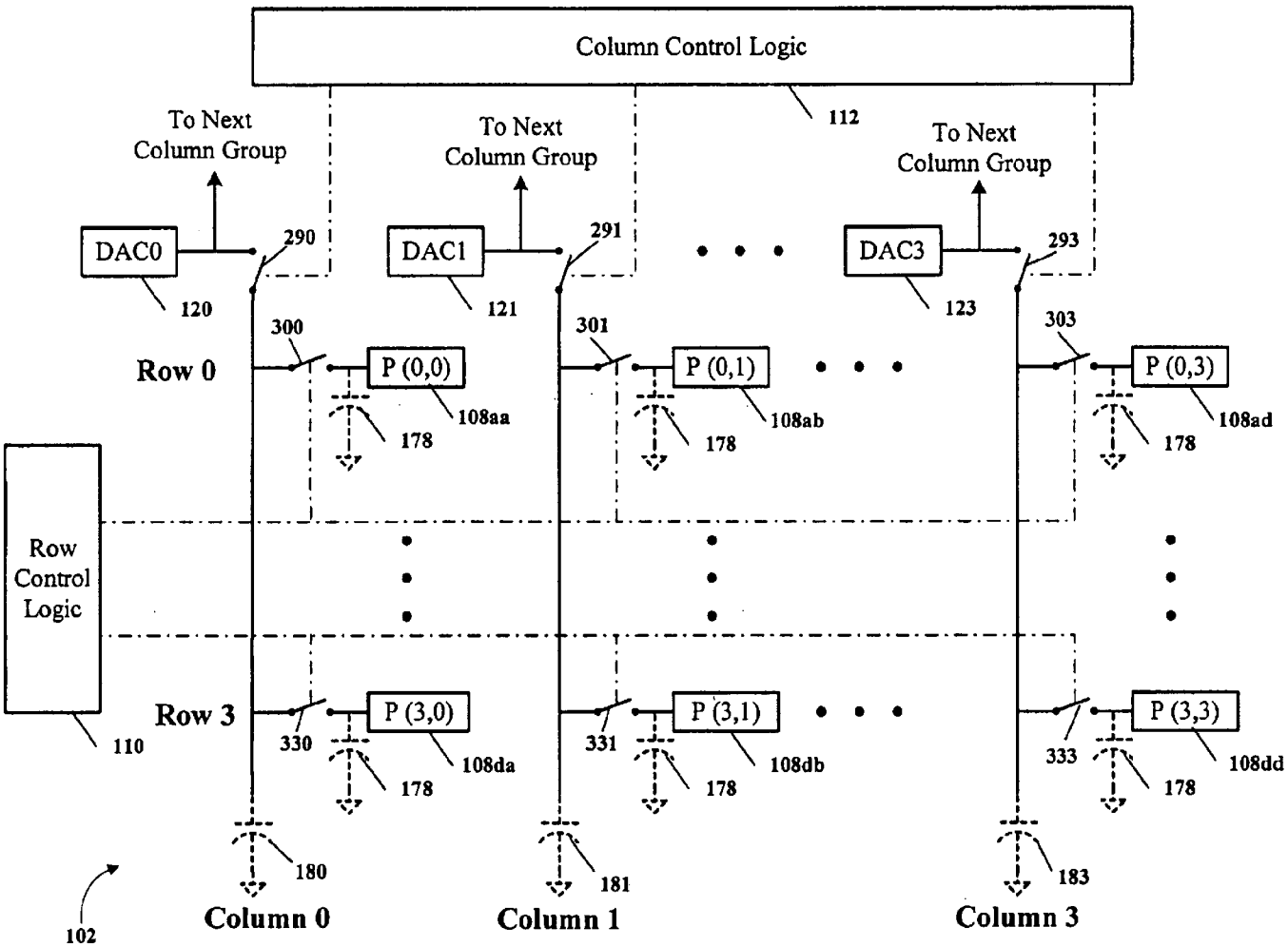
FIG. 4 is a schematic diagram of a portion of the liquid crystal display of FIG. 3.

Referring now to FIG. 4, depicted is a schematic block diagram of a portion of the liquid crystal display system 100 of FIG. 3. A portion of the pixel matrix 102 is represented for illustrative and exemplary purposes as pixels 108*a*a-108*d*d (4×4 matrix), pixel row switches 300 through 333 and pixel column switches 290 through 293. An LCD operates by placing a desired voltage charge at each pixel 108*a a*–108*dd* of the LCD 100. A voltage charge at a pixel 108 causes liquid crystals at that pixel area to change their "twist" orientation so that light passing through the LCD 100 or being reflected is thereby affected. The translation logic 114 uses the received video frame information 116 to create appropriate digital values that are sent to the DACs 120–123 which are representative of that portion of the video frame at each one of the pixel locations. In addition, the translation logic 114 associates an x-y coordinate (row-column) location for each of these pixel voltage values and sends same to the row control logic 110 and column control logic 112.

The DACs 120–123 receive digital representations of video pixel values from the translation logic 114 and convert these digital representations to analog values, e.g., voltage or current, which must then be applied to each corresponding column 104. Each of the pixels 108*aa*–108*dd* has a capacitance 178 associated therewith, and each of the columns 0, 1, 2 (not illustrated) and 3 has a capacitance 180, 181, 182 (not illustrated) and 183, respectively, associated therewith. The capacitance 178 of each pixel may not all be the same, nor may the capacitance 180, 181, 182 and 183 of each column be the same. However, a column capacitance, e.g., 180 is greater than a pixel capacitance, e.g., 178. The column capacitance is charged to a desired voltage value. The output of the DAC is connected to the column and thereby charges the column capacitance to a desired analog voltage, each pixel in a selected row is connected to a corresponding column. Therefore, the voltage on the pixel will be substantially the same as the voltage on the corresponding column.

For example, a column(s) is charged to a certain voltage while a pixel row is selected so that the intersection(s) thereof is the desired pixel to be charged. For example, columns 0–3 are charged from the DACs 120–123, respectively, when the column switches 290–293 are closed. The capacitance 178 of each of the pixels 108*aa*–108*dd* are charged from the columns 0–3, respectively, when the row switches 300–303 are closed. A plurality of DACs may be used to simultaneously charge the capacitance of a like number of columns, then a like number of switches in a row may be used to charge the capacitance of a like number of pixels from the respective charged columns. The column control logic 112 and row control logic 110 control operation of the column switches 290–293 and row switches 300–333, respectively, for the group of pixels 108*aa*–108*dd*. Other pixel groups 108 are controlled in a similar fashion.

Figure 5:
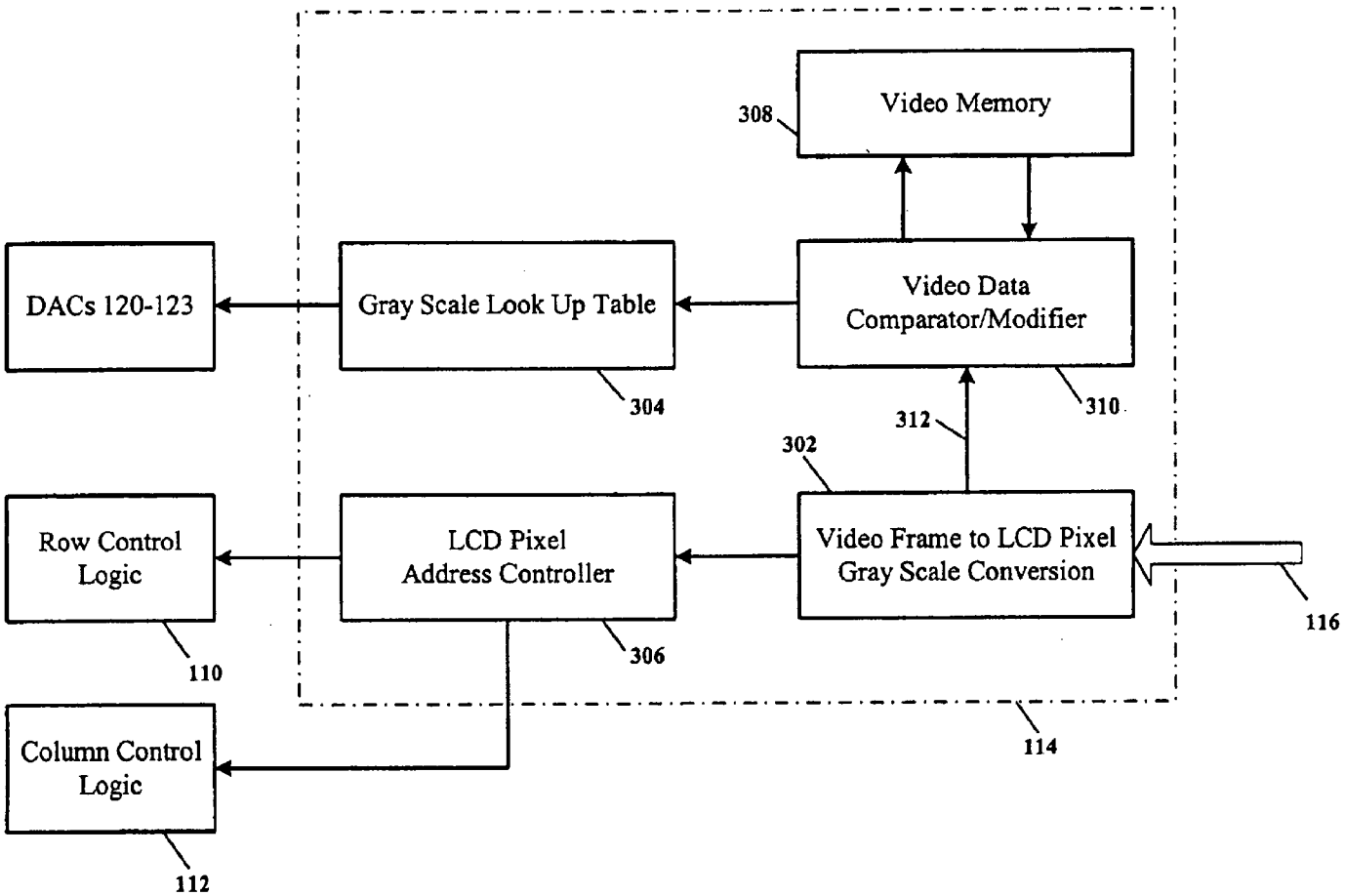
FIG. 5 is a schematic block diagram of an exemplary embodiment of the invention.

Referring now to FIG. 5, depicted is a schematic block diagram of an exemplary embodiment of the invention. The DACs 120–123 are adapted to receive digital amplitude information from a gray scale look up table 304. The gray scale look up table 304 receives pixel grayscale information from the video data comparator/modifier logic 310 which compares gray scale values of adjacent pixels and may modify one or both values so as to keep the voltage magnitude change between pixel voltage values to within a desired limit. The video data comparator/modifier logic 310 receives pixel gray scale values 312 from the video frame to LCD pixel gray scale conversion and pixel address logic 302. The video frame to LCD pixel gray scale conversion and pixel address logic 302 is adapted to convert video information 116 into corresponding pixel information (grayscale and pixel address information). Pixel address information is sent to an LCD pixel address controller 306 which is adapted to control the row control logic 110 and column control logic 112 (FIG. 3). A video memory 308 may be used to store the modified video data. In addition, the video memory 308 may also be used to store a previous row of video data for comparison with the present row of video data. The video memory may also be used to store one or more adjacent pixel video data values before and/or after modification, etc.

In describing the exemplary embodiments disclosed herein, a pixel voltage value (the voltage value charge on the pixel capacitor) representing black may be referred to as black or level A (00$_h$ input to an 8-bit DAC), and a pixel voltage value representing white may be referred to as white or level D (FF$_h$ input to the 8 bit DAC). Gray levels may be referred to as gray or level C (greater than black—00$_h$ and less than white—FF$_h$ to the 8 bit DAC). DACs having more or less input bits are contemplated herein and are within the scope of the present invention.

Figure 6:
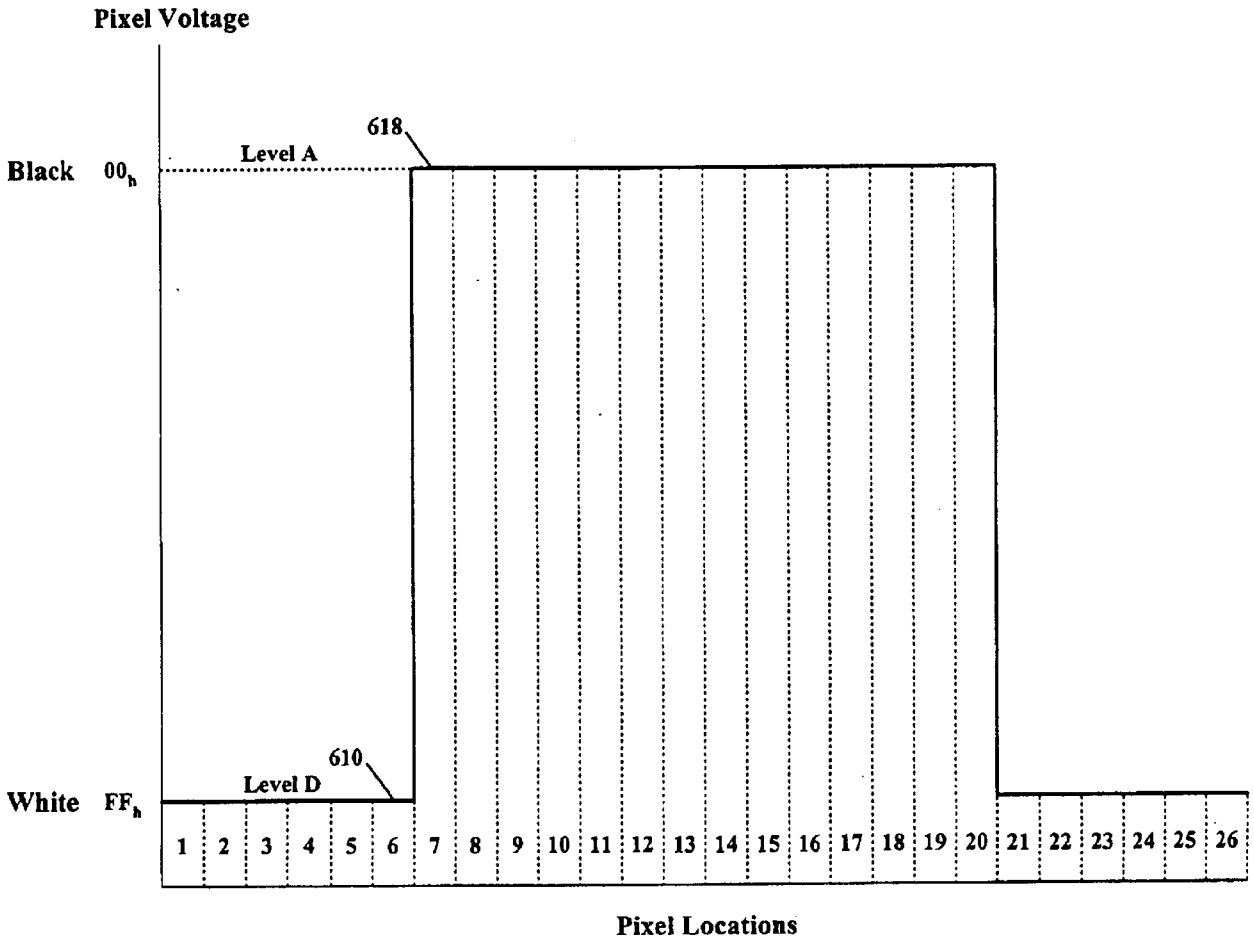
FIGURE 6 (Prior Art)
FIG. 6 is a graph of pixel voltage levels verses pixel locations illustrating operation of prior art liquid crystal display systems.

Referring to FIG. 6, depicted is a graph of pixel voltage levels verses pixel locations illustrating operation of a prior art liquid crystal display system. A pixel at location 610 has a white voltage level FF$_h$ (level D) and an adjacent pixel at location 618 has a black voltage level 00$_h$ (level A). This voltage magnitude difference between the pixels at locations 610 and 618 may be large enough to cause image degradation by fringe effect fields between those two pixels.

Figure 7:
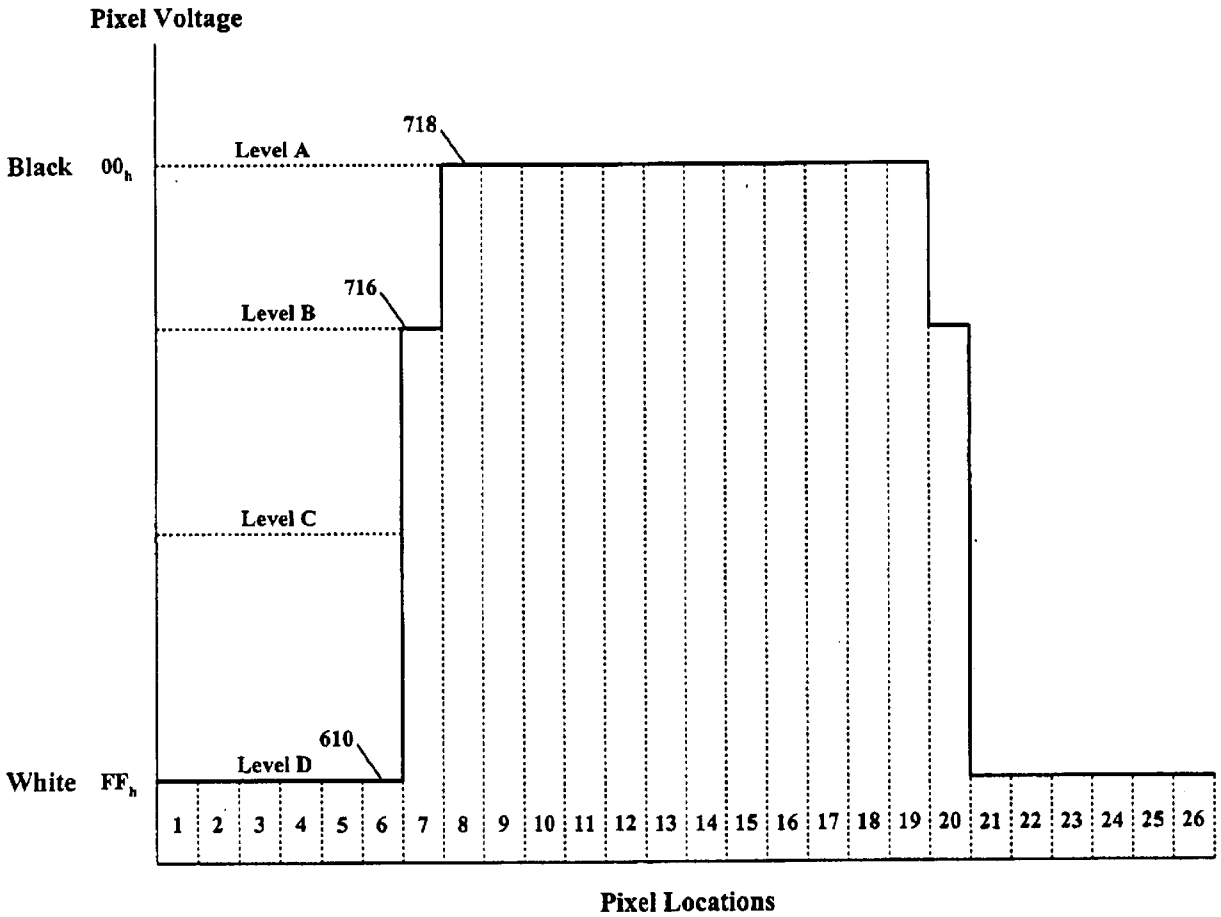
FIG. 7 is a graph of pixel voltage levels verses pixel locations illustrating operation of a liquid crystal display system according to an exemplary embodiment of the invention.

Referring to FIG. 7, depicted is a graph of pixel voltage levels verses pixel locations illustrating operation of a liquid crystal display system, according to an exemplary embodiment of the invention. A pixel at location 610 has a white voltage level FF$_h$ (level D) and an adjacent pixel at location 716 has less than a black (gray) voltage level (level B). The very next pixel location 718 has a black voltage level 00$_h$ (level A). The voltage magnitude differences between the adjacent pixels at locations 610 and 716, and locations 716 and 718 are not large enough to cause image degradation by fringe effect fields.

Referring back to FIG. 5, the video data comparator/modifier 310 may comprise a shift register and a comparator. The video source data 116 is fed from the video frame to LCD pixel gray scale conversion logic 302 to the shift register in the video data comparator/modifier 310. The comparator in the video data comparator/modifier 310 analyzes the pixel values in the shift register and restricts all pixels values less than B that are adjacent to pixel values having at least a gray level C to substantially black video values of level B (00$_h$<B<C). Alternatively, the pixels values less (darker) than level B may be reduced by a factor k (increases the gray level), if the pixel to be written to borders a gray level pixel having a gray level between C and D, where k, B and C are parameters that may be selected for the most pleasing images. For a sequential color LCD system, only one shift register need be used. For a three color (red-green-blue) LCD system, three shift registers may be used, one for each color portion of the RGB LCDs.

In another exemplary embodiment of the invention, the video source pixel data that was written to a previous row is stored in a video memory in the video data comparator/modifier 310 so that a comparison of previous row pixel value data can be made and the present row video source pixel data modified as describe herein. Thus both adjacent column and row pixels may be compared so that any adjacent pixel will not be written to a voltage level producing a fringe field great enough to cause image degradation.

Figure 8:
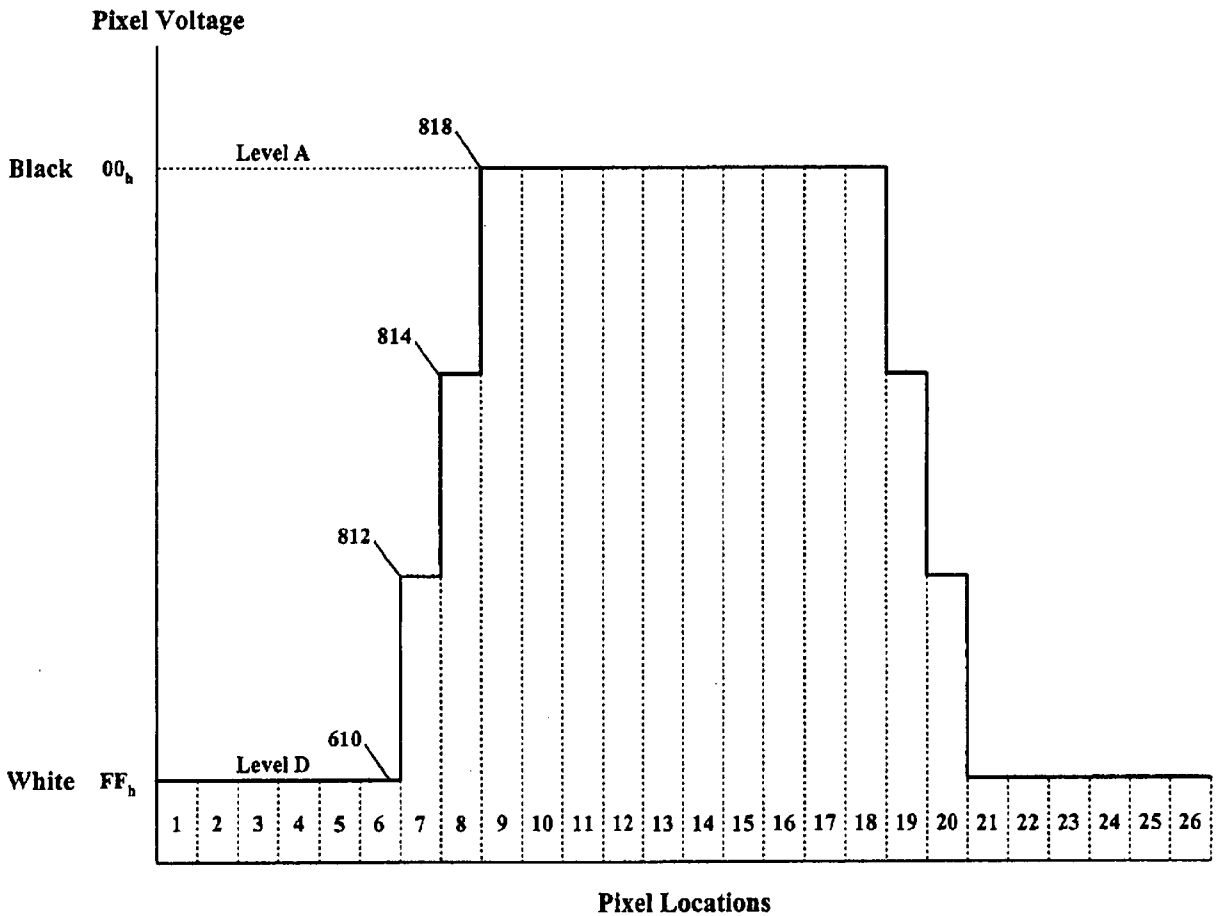
FIG. 8 is a graph of pixel voltage levels verses pixel locations illustrating a liquid crystal display system according to another exemplary embodiment of the invention.

Referring to FIG. 8, depicted is a graph of pixel voltage levels verses pixel locations illustrating a liquid crystal display system according to another exemplary embodiment of the invention. The magnitude change in adjacent pixel voltage values will be reduced by averaging the required magnitude change over a sufficient number of pixels so that no adjacent pixels will have a voltage value change resulting in a voltage change between adjacent pixels that is larger than a desired magnitude. This may be accomplished by dividing the input video data voltage value magnitude change between adjacent pixels by the desired voltage value magnitude change. This determines the "number of pixels" over which the total video data voltage value magnitude change can be obtained without exceeding the desired voltage value magnitude change between any two adjacent pixels. This results in a more gradual change in voltage values, e.g., "stairstep" adjacent pixel voltage value changes over the number of adjacent pixels until reaching the total video data voltage value magnitude change. A stair-step voltage change is illustrated at pixel locations 812, 814 and 818.

Modification of voltage values for adjacent pixels on the same row may be as described herein as well as adjacent pixels on adjacent rows. It is contemplated and within the scope of the present invention that a video memory may be utilized to store voltage values written to pixels on previous rows and/or columns so that no adjacent pixels have a voltage value difference great enough to cause field fringe effects.

Figure 9:
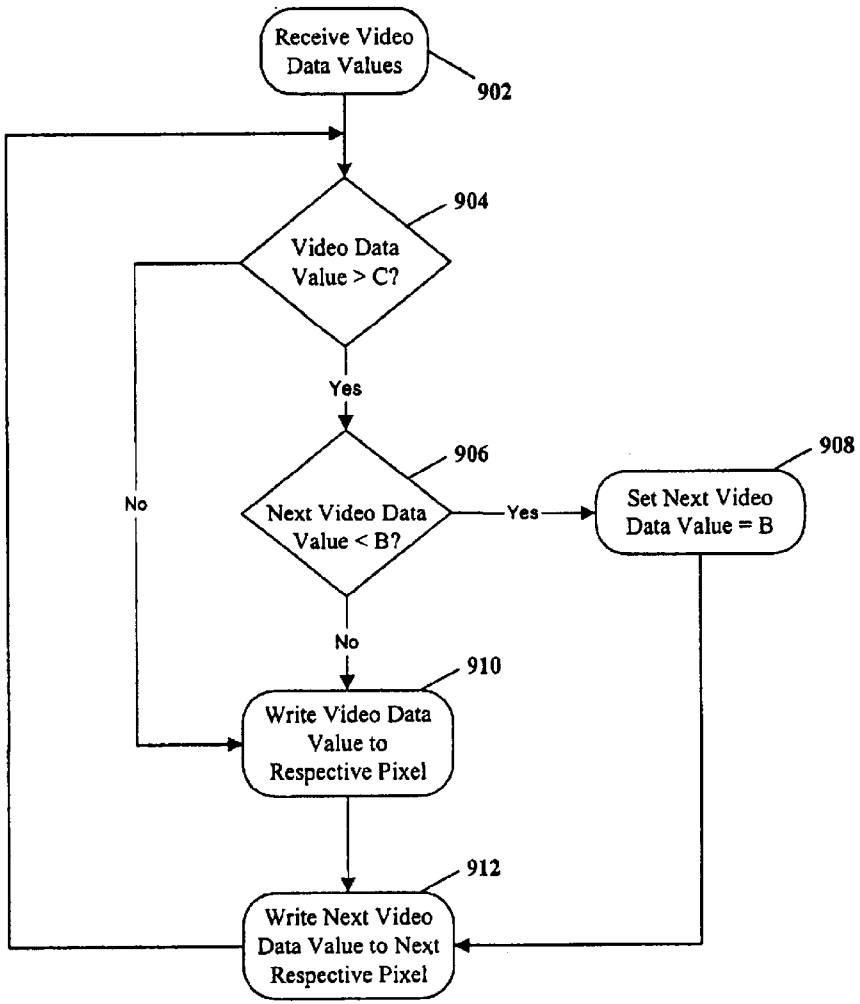
FIG. 9 is a schematic flow diagram of an exemplary embodiment of the invention.

Referring to FIG. 9, depicted is a schematic flow diagram of an exemplary embodiment of the invention. The graph of FIG. 7 illustrates the operation of this exemplary embodiment. Video data values are received in step 902. A received video data value is checked in step 904 to determine if it is greater than a gray level C. If not, then that received video data value is written to its respective pixel in step 910. If greater than gray level C, then the next received video data value is checked in step 906 to determine if it is less than a gray level B. If the next received video data value is greater than or equal to a gray level B, then the next received video data value is written to the next respective pixel in step 912. If less than gray level B, then the next received video data value is set to gray level B and is written to the next respective pixel in step 912. The aforementioned steps are performed for each video data value before being written to the respective pixels.

Figure 10:
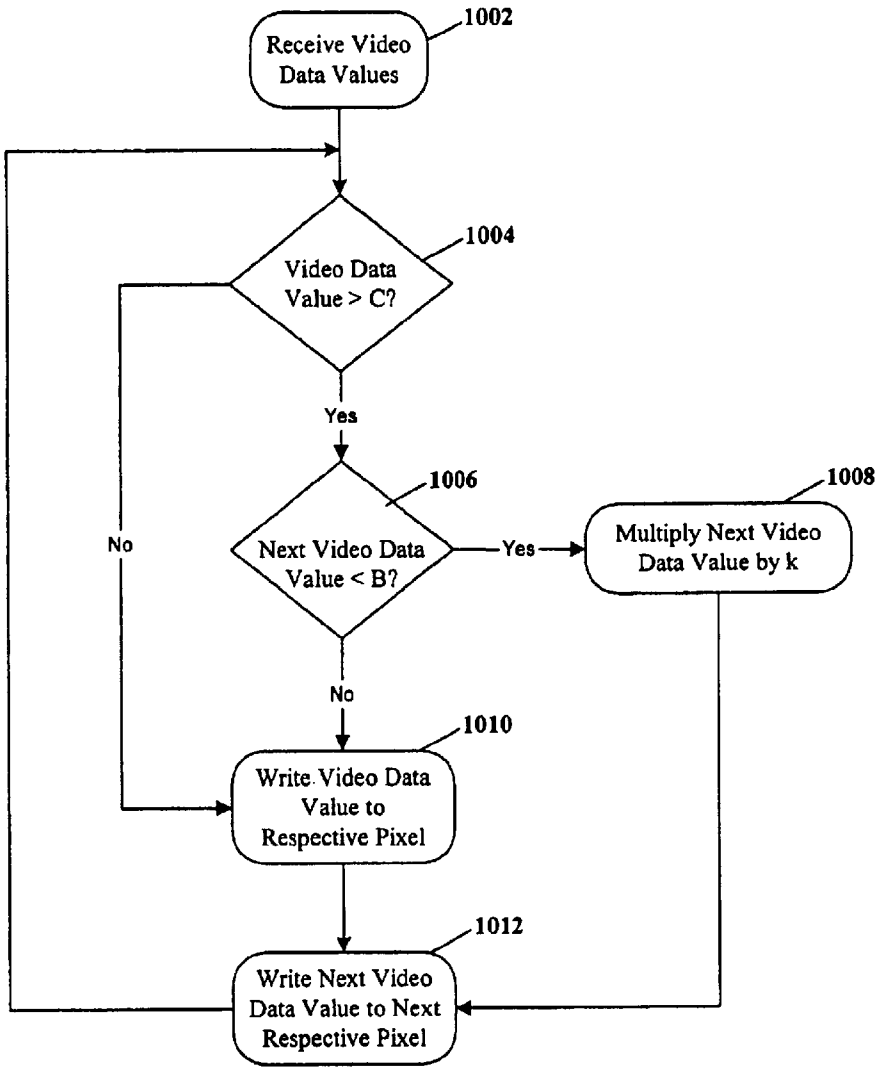
FIG. 10 is a schematic flow diagram of another exemplary embodiment of the invention.

Referring to FIG. 10, depicted is a schematic flow diagram of another exemplary embodiment of the invention. Video data values are received in step 1002. A received video data value is checked in step 1004 to determine if it is greater than a gray level C. If not, then that received video data value is written to its respective pixel in step 1010. If greater than gray level C, then the next received video data value is checked in step 1006 to determine if it is less than a gray level B. If the next received video data value is greater than or equal to a gray level B, then the next received video data value is written to the next respective pixel in step 1012. If less than gray level B, then the next received video data value is multiplied by a constant k and is written to the next respective pixel in step 1012. The aforementioned steps are performed for each video data value before being written to the respective pixels.

Figure 11:
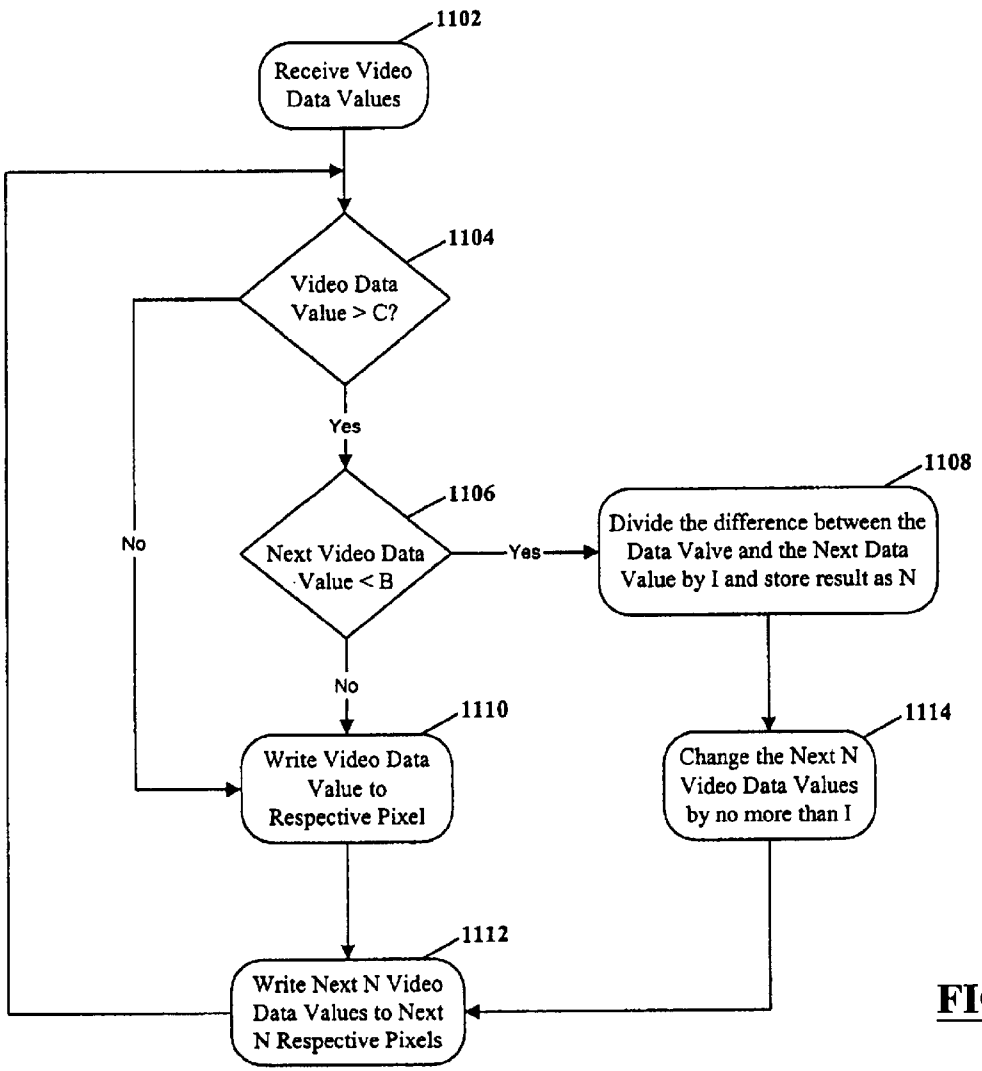
FIG. 11 is a schematic flow diagram of another exemplary embodiment of the invention.

Referring to FIG. 11, depicted is a schematic flow diagram of another exemplary embodiment of the invention. The graph of FIG. 8 illustrates the operation of this exemplary embodiment. Video data values are received in step 1102. A received video data value is checked in step 1104 to determine if it is greater than a gray level C. If not, then that received video data value is written to its respective pixel in step 1110. If greater than gray level C, then the next received video data value is checked in step 1106 to determine if it is less than a gray level B. If the next received video data value is greater than or equal to a gray level B, then the next received video data value is written to the next respective pixel in step 1112. If less than gray level B, then the difference between the video data value and the next video data value is divided by I and the result is stored as N in step 1108. In step 1114, the next N video data values are changed by no more than I. In step 1112, the next N video data values are written to the next N respective pixels. The aforementioned steps are performed for each video data value before being written to the respective pixels.

Figure 12:
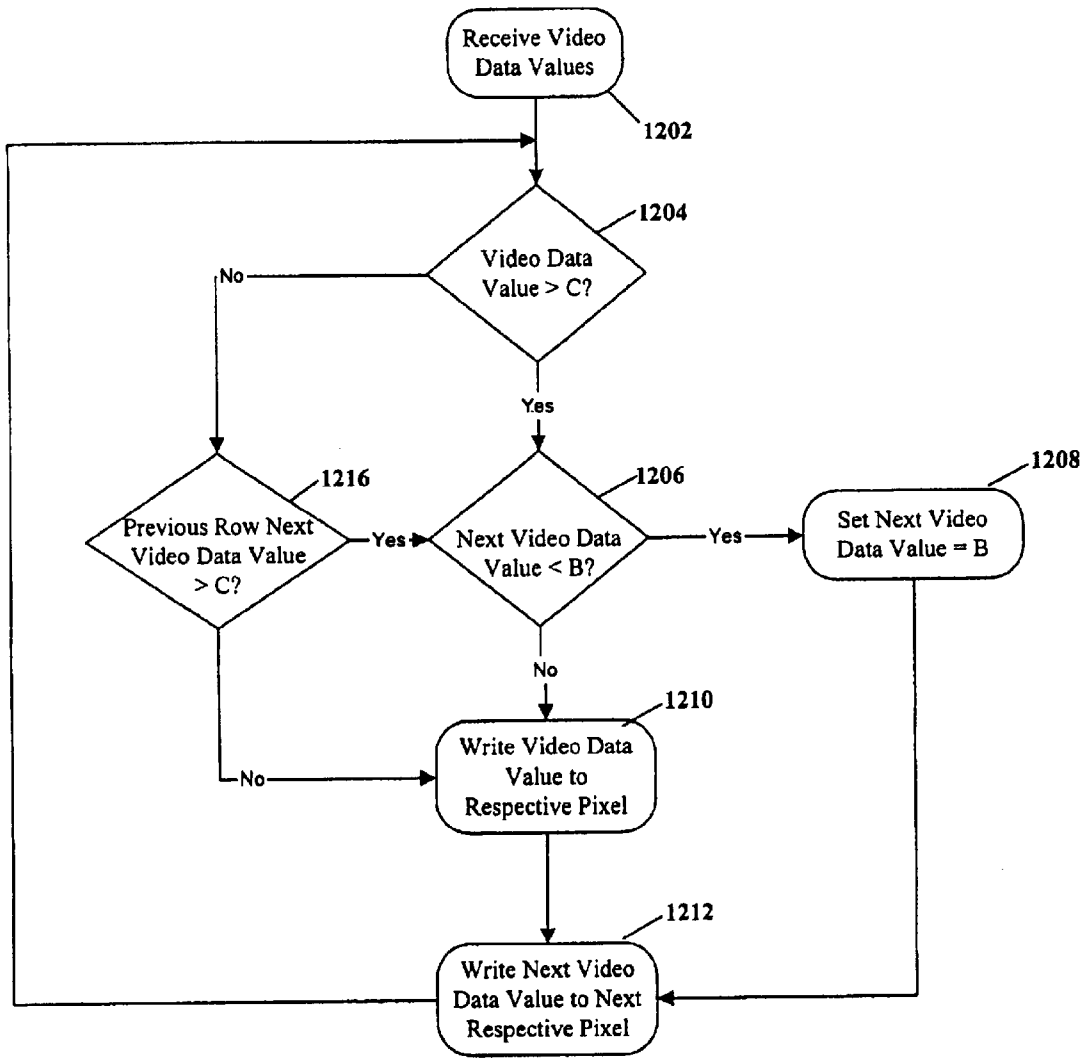
FIG. 12 is a schematic flow diagram of another exemplary embodiment of the invention.

Referring to FIG. 12, depicted is a schematic flow diagram of another exemplary embodiment of the invention. Video data values are received in step 1202. A received video data value is checked in step 1204 to determine if it is greater than a gray level C. If not, then a previous row next video data value is checked in step 1216 to determine if it is greater than a gray level C. If not, then that received video data value is written to its respective pixel in step 1210. If video data value is greater than gray level C, then the next received video data value is checked in step 1206 to determine if it is less than a gray level B. If the next received video data value is greater than or equal to a gray level B, then the next received video data value is written to the next respective pixel in step 1212. If less than gray level B, then the next received video data value is set to gray level B and is written to the next respective pixel in step 1212. If the previous row next video data value is greater than gray level C, then the next received video data value is checked in step 1206 to determine if it is less than a gray level B. If the next received video data value is greater than or equal to a gray level B, then the next received video data value is written to the next respective pixel in step 1212. If less than gray level B, then the next received video data value is set to gray level B and is written to the next respective pixel in step 1212. The aforementioned steps are performed for each video data value before being written to the respective pixels.

Figure 13:
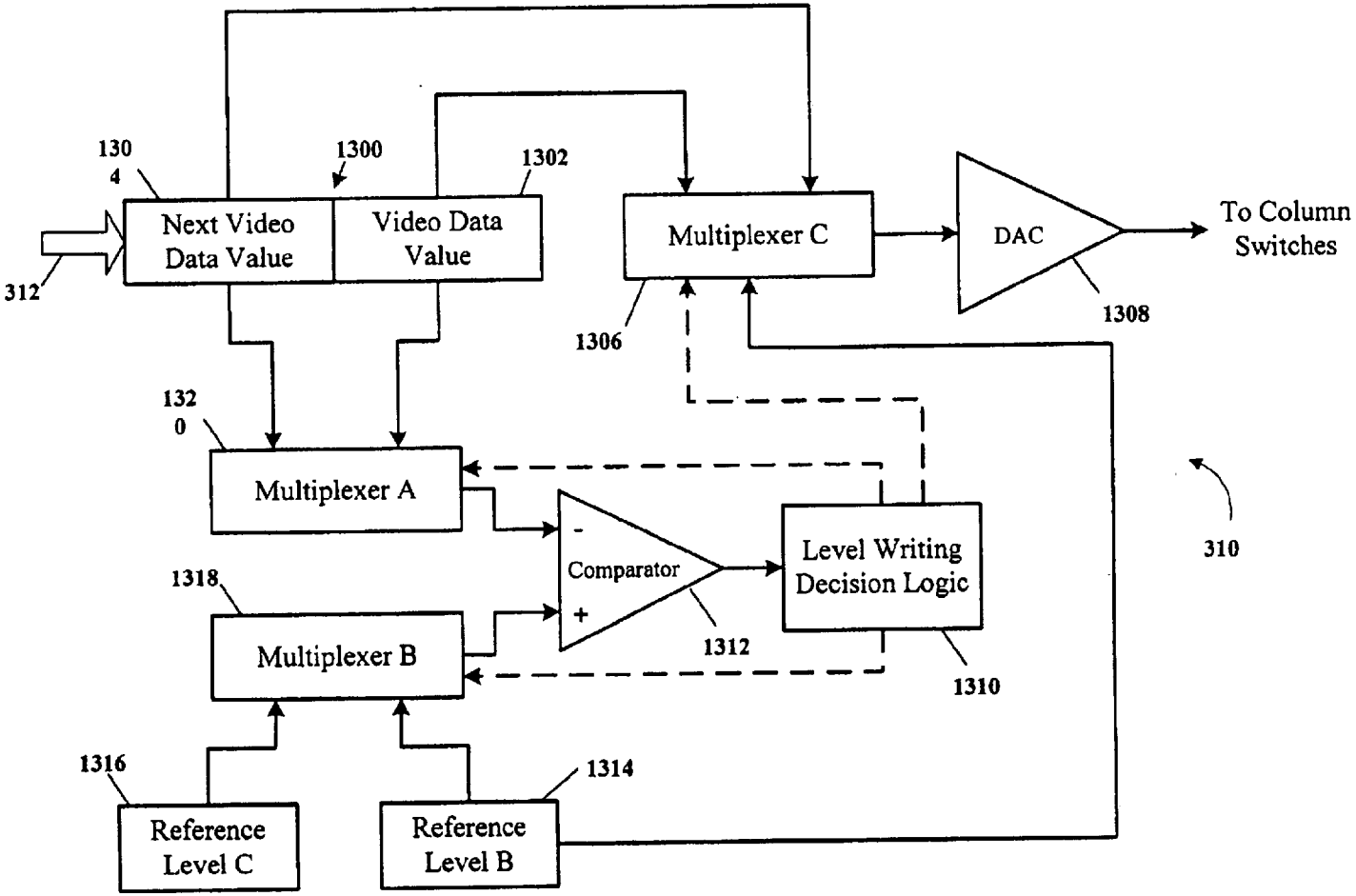
FIG. 13 is a schematic block diagram of another exemplary embodiment of the invention.

Referring to FIG. 13, depicted is a schematic block diagram of an exemplary embodiment of the invention. The schematic block diagram embodiment illustrated in FIG. 13 is an exemplary implementation of the flow diagram of FIG. 9. Other implementations are equally effective and would occur to those having ordinarily skills in the pertinent arts and having the benefit of this disclosure. Pixel gray scale values 312 may be received in a shift register 1300. A video data value may be stored in shift register storage element 1302 and a next video data value may be stored in shift register storage element 1304. A multiplexer 1306 is adapted to select the video data value, the next video data value or a data value at level B. Once a selection is made of the input of the multiplexer 1306, the output of the multiplexer 1306 drives a digital-to-analog converter (DAC) 1308 which charges an appropriate column connected to the desired pixel to be charged.

A multiplexer 1320 selects either the video data value stored in the storage element 1302 or the next video data value stored in the storage element 1304. The output of the multiplexer 1320 is coupled to a first input of a comparator 1312. A multiplexer 1318 selects either a reference level C 1316 or a reference level B 1314, and its output is coupled to a second input of the comparator 1312. The comparator 1312 compares the video data value to reference level C and the next video data value to reference level B. Depending on these comparisons, the level writing decision logic 1310 selects the appropriate video pixel data value for driving the DAC 1308. The selection from the decision logic 1310 is in accordance with the flow diagram illustrated in FIG. 9.

Figure 14:
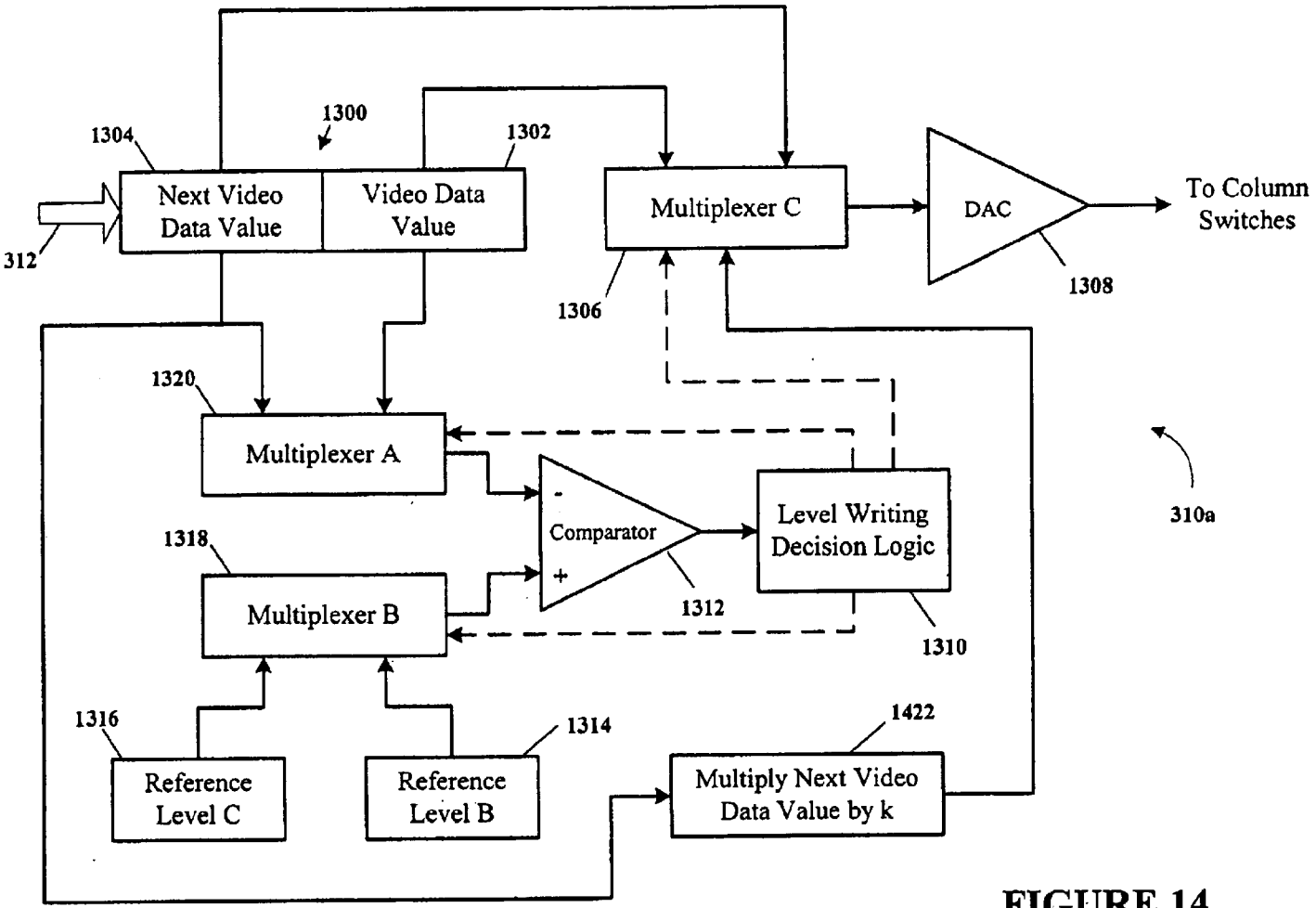
FIG. 14 is a schematic block diagram of still another exemplary embodiment of the invention.

Referring to FIG. 14, depicted is a schematic block diagram of still another exemplary embodiment of the invention. The schematic block diagram embodiment illustrated in FIG. 14 is an exemplary implementation of the flow diagram of FIG. 10. Other implementations are equally effective and would occur to those having ordinarily skill in the pertinent arts and having the benefit of this disclosure. Pixel gray scale values 312 may be received in a shift register 1300. A video data value may be stored in shift register storage element 1302 and a next video data value may be stored in shift register storage element 1304. A multiplexer 1306 is adapted to select the video data value, the next video data value or the next video data value multiplied by k. Once a selection is made of the input of the multiplexer 1306, the output of the multiplexer 1306 drives a digital-to-analog converter (DAC) 1308 which charges an appropriate column connected to the desired pixel to be charged.

A multiplexer 1320 selects either the video data value stored in the storage element 1302 or the next video data value stored in the storage element 1304. The output of the multiplexer 1320 is coupled to a first input of a comparator 1312. A multiplexer 1318 selects either a reference level C 1316 or a reference level B 1314, and its output is coupled to a second input of the comparator 1312. The comparator 1312 compares the video data value to reference level C and the next video data value to reference level B. Depending on these comparisons, the level writing decision logic 1310 selects the appropriate video pixel data value for driving the DAC 1308. The selection from the decision logic 1310 is in accordance with the flow diagram illustrated in FIG. 10.

It is contemplated and within the scope of the embodiments of the invention that the LCD and/or LCD system may be partially or entirely fabricated on a semiconductor integrated circuit or integrated circuits.

The invention, therefore, is well adapted to carry out the objects and attain the ends and advantages mentioned, as well as others inherent therein. While the invention has been depicted, described, and is defined by reference to exemplary embodiments of the invention, such references do not imply a limitation on the invention, and no such limitation is to be inferred. The invention is capable of considerable modification, alternation, and equivalents in form and function, as will occur to those having ordinarily skills in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A system for improving image quality of a liquid crystal display (LCD), said system comprising:

a matrix of pixels arranged in a plurality of columns and a plurality of rows, wherein an intersection of a row and a column defines a location of a pixel in said matrix;

at least one digital-to-analog converter (DAC) having a digital input and an analog output;

a plurality of column switches adapted for coupling the analog output of said at least one DAC to each of said plurality of columns;

a plurality of row switches adapted for selectively coupling each of said plurality of rows to said plurality of columns;

column control logic for controlling said plurality of column switches;

row control logic for controlling said plurality of row switches;

a video frame to gray scale conversion and pixel address logic for converting video information into LCD gray scale values and corresponding pixel address locations thereof; and video data comparator/modifier logic, said video data comparator/modifier logic adapted to receive the LCD gray scale values for each pixel of the matrix of pixels, wherein gray scale values of adjacent pixels are compared and if a difference in magnitudes between the gray scale values of adjacent pixels is greater than a desired value, then at least one of the gray scale values is modified so that the difference in magnitudes therebetween is no greater than the desired value;

said video data comparator/modifier logic is adapted for sending all unmodified gray scale values and any modified gray scale values to said at least one DAC;

said video frame to gray scale conversion and pixel address logic adapted for sending said pixel address locations to said column control logic and said row control logic.

2. The system of claim 1, further comprising a video memory for storing said LCD gray scale values.

3. The system of claim 1, further comprising a video memory for storing said unmodified and said modified LCD gray scale values.

4. The system of claim 1, further comprising a video memory coupled to said video data comparator/modifier logic.

5. The system of claim 1, wherein said video data comparator/modifier logic comprises at least one comparator and at least one shift register, said at least one shift register adapted for storing gray scale values for at least one pixel and at least one adjacent pixel.

6. The system of claim 5, wherein said video data comparator/modifier logic comprises a level writing decision logic for determining magnitude differences between adjacent pixel LCD gray scale values.

7. The system of claim 6, wherein said level writing decision logic determines which of said LCD gray scale values are modified.

8. The system of claim 1, further comprising a gray scale look-up table coupled between said video data comparator/modifier logic and said at least one DAC.

9. The system of claim 1, wherein said LCD, said plurality of column switches and said plurality of row switches are fabricated on a semiconductor integrated circuit.

10. The system of claim 1, wherein said LCD, said plurality of column switches, said plurality of row switches, said column control logic, and said row control logic are fabricated on a semiconductor integrated circuit.

11. The system of claim 1, wherein said video frame to gray scale conversion and pixel address logic, said video data comparator/modifier logic and said at least one DAC are fabricated on a t least one semiconductor integrated circuit.

12. A method for improving image quality of a liquid crystal display (LCD) comprising a matrix of pixels arranged in a plurality of rows and columns, wherein an intersection of a row and a column defines a position of a pixel in the matrix, said method comprising the steps of:

determining if a gray scale value of a pixel is greater than a first reference value and writing the gray scale value to the pixel location, wherein;

if the gray scale value of the pixel is less than or equal to the first reference value, then writing a gray scale value of an adjacent pixel to the adjacent pixel, and if the gray scale value of the pixel is greater than the first reference value, then determining if the gray scale value of the adjacent pixel is less than a second reference value, if so, then writing the second reference value to the adjacent pixel, and if not, then writing the gray scale value of the adjacent pixel to the adjacent pixel.

13. The method of claim 12, further comprising the steps of:

receiving video information; and converting the video information into the LCD gray scale values and the corresponding pixel address locations thereof.

14. The method of claim 12, further comprising the step of storing the LCD gray scale values in a memory.

15. A method for improving image quality of a liquid crystal display (LCD) comprising a matrix of pixels arranged in a plurality of rows and columns, wherein an intersection of a row and a column defines a position of a pixel in the matrix, said method comprising the steps of:

determining if a gray scale value of a pixel is greater than a first reference value and writing the gray scale value to the pixel location, wherein;

if the gray scale value of the pixel is less than or equal to the first reference value, then writing a gray scale value of an adjacent pixel to the adjacent pixel, and if the gray scale value of the pixel is greater than the first reference value, then determining if the gray scale value of the adjacent pixel is less than a second reference value, if so, then multiplying the gray scale value of the adjacent pixel by k and writing the product thereof to the adjacent pixel, and if not, then writing the gray scale value of the adjacent pixel to the adjacent pixel.

16. A method for improving image quality of a liquid crystal display (LCD) comprising a matrix of pixels arranged in a plurality of rows and columns, wherein an intersection of a row and a column defines a position of a pixel in the matrix, said method comprising the steps of:

determining if a gray scale value of a pixel is greater than a first reference value and writing the gray scale value to the pixel location, wherein;

if the gray scale value of the pixel is less than or equal to the first reference value, then writing a gray scale value of an adjacent pixel to the adjacent pixel, and if the gray scale value of the pixel is greater than the first reference value, then determining if the gray scale value of the adjacent pixel is less than a second reference value, if so, then dividing the difference between the gray scale values of the pixel and the adjacent pixel by I and storing the result as N and changing the next N adjacent pixel gray scale values by no more than I, and writing the changed next N gray scale values to the next N adjacent pixels, and if not, then writing the gray scale value of the adjacent pixel to the adjacent pixel.

17. The method of claim 12, wherein the pixel and the adjacent pixel are on the same row.

18. The method of claim 12, wherein the pixel and the adjacent pixel are on different rows.

19. The method of claim 15, wherein the pixel and the adjacent pixel are on the same row.

20. The method of claim 15, wherein the pixel and the adjacent pixel are on different rows.

* * * * *